United States Patent [19]

Meneely

[11] Patent Number: 4,898,128

[45] Date of Patent: Feb. 6, 1990

[54] ANTI-LASH ADJUSTER

[76] Inventor: Vincent A. Meneely, 9837 McKinnon Crescent R.R. No. 10, Langley, B.C., Canada, V3A 6X5

[21] Appl. No.: 179,034

[22] Filed: Apr. 7, 1988

[51] Int. Cl.[4] ..... F02D 9/06

[52] U.S. Cl. ..... 123/90.12; 123/90.16; 123/321

[58] Field of Search ..... 123/90.12, 90.16, 321, 123/323

[56] References Cited

U.S. PATENT DOCUMENTS

| | | | |
|---|---|---|---|
| 4,150,640 | 4/1979 | Egan | 123/90.12 |
| 4,398,510 | 8/1983 | Custer | 123/90.16 |
| 4,399,787 | 8/1983 | Cavanagh | 123/90.16 |
| 4,466,390 | 8/1984 | Babitzka et al. | 123/90.12 |
| 4,655,178 | 4/1987 | Meneely | 123/321 |
| 4,664,070 | 5/1987 | Meistrick et al. | 123/321 |
| 4,674,451 | 6/1987 | Rembold et al. | 123/90.12 |

*Primary Examiner*—Willis R. Wolfe
*Assistant Examiner*—M. Macy
*Attorney, Agent, or Firm*—Shlesinger & Myers

[57] ABSTRACT

An anti-lash adjuster for compression relief brakes on internal-combustion engines. The anti-lash adjuster has a slave piston adapted to contact the valve-actuating mechanism for the exhaust valves. The slave piston has a predetermined surface area and a retracting spring which biases the slave piston to a retracted position. A forward bias unit is provided to assist oil under engine-oil pressure in overcoming the retracting force to bias the slave piston to an extended position. The forward bias unit only assists the engine-oil pressure in overcoming the retracting force over a limited distance. The distance may be selected to keep the exhaust valves open throughout brake operations or only to take up the lash during brake operation or to take up part of the lash. A master piston is provided to further open the valves during portions of brake operation. There is means, such as an aperture extending through the slave piston, to prevent the slave piston from moving away from the forward bias unit. The forward bias unit normally seals the aperture when in contact with the slave piston.

6 Claims, 1 Drawing Sheet

ANTI-LASH ADJUSTER

DESCRIPTION

The invention relates to an apparatus for compression relief in an internal-combustion engine for braking the engine. Specifically, the invention relates to an improved apparatus for assisting engine oil pressure to position a slave piston for compression relief braking. There is a device for stopping oil pressure alone from jacking down the slave piston.

BACKGROUND ART

A variety of methods have been employed to utilize the compression of an internal-combustion engine for braking when a vehicle is moving down a grade. One such method is disclosed by Custer in U.S. Pat. No. 4,398,510. In the device disclosed in the Custer patent, the exhaust valves of an internal-combustion engine are opened at a point in the compression stroke when they would normally remain closed.

To ensure proper operation of an internal-combustion engine, a minimum cold clearance, typically on the order of 0.018 inch, is maintained in the valve-actuating mechanism of the engine. This clearance is necessary to prevent premature opening of the exhaust valves when the engine becomes hot. The improvement disclosed by Custer is an anti-lash timing mechanism which takes up this cold clearance during brake operation to improve the opening and closing of the exhaust valves during the various cycles of the engine. The timing mechanism of Custer displaces a slave piston to take up the cold clearance when the brake is in operation so that a high-pressure pulse of engine oil from a master piston driven off a fuel injector camshaft can open the exhaust valves at the appropriate time.

The Custer timing mechanism, however, is too complex. The mechanism employs two coaxial springs, a ball check valve within an inner closely fitting piston, and various pins to limit the degree of lash take-up. This structure is necessary to axially extend and lock the piston in its extended position. Thus, a need exists for a different compression relief brake operating mechanism which can control the operation of the exhaust valves during brake operation with a minimum of moving parts and close tolerances.

My previous U.S. Pat. No. 4,655,178 issued Apr. 7, 1987, discloses an Anti-Lash Adjuster. However, it has been found that in some cases at least, such as with Cummins engines, it is difficult to fit a compression spring of the required strength in the available space. This could be compensated for by reducing the strength of the return spring, but this could cause engine damage because the slave piston could be jacked down by engine oil pressure which overcomes the weaker return spring. On each cycle the exhaust valves are fully opened on the exhaust stroke. With the force of the valve springs thus removed, the oil pressure may be enough to move the slave piston down, while return is prevented by the check valve. Thus the slave piston may be jacked down over a period of time until the exhaust valves are opened enough to strike the pistons of the engine.

DISCLOSURE OF THE INVENTION

It is an object of the invention to provide a compression relief brake operating mechanism having a simplified construction.

The invention achieves these and other objects which will become apparent in the description which follows by providing a compression relief brake having a forward bias unit which assists engine oil pressure in displacing a slave piston to take up cold clearance or lash between the slave piston and the exhaust valves and to keep the exhaust valves open during the operation of the brake. The forward bias unit has a loose tolerance finger having a limited extension so that an assist force is applied to the surface of the slave piston over a distance limited to the extension of the loose tolerance finger. The slave piston has a return spring and a predetermined surface area. Engine oil pressure in combination with the supplemental force from the loose tolerance finger can bias the slave piston to an extended position. As determined by the length of the limited extension of the finger, the slave piston can be biased to a position which takes up cold clearance so that a pulse of high-pressure oil from a master piston will open the exhaust valves at a predetermined time and so that the valves can be kept opened throughout the brake action. There is means, such as an aperture through the slave piston, for preventing oil pressure alone from moving the slave piston. The aperture is normally sealed by the finger, but is opened to release oil through the aperture to the crankcase if the slave piston moves away from its extended position and the finger.

In one embodiment, the loose tolerance finger has an extension limit of 0.0108 inch to keep the exhaust valves slightly open throughout the operation of the compression brake when the invention is used on a vehicle having a typical cold clearance between the slave piston and the exhaust valves of 0.018 inch.

BRIEF DESCRIPTION OF THE DRAWING

The FIGURE is a schematic and diagrammatic representation of a compression relief brake employing the present invention.

BEST MODE FOR CARRYING OUT THE INVENTION

Figure 1:
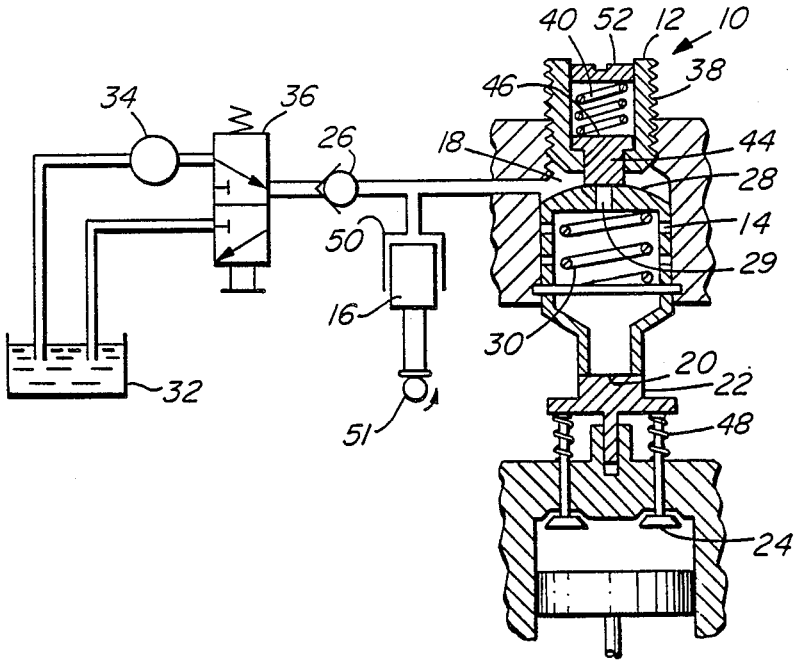

A compression relief brake, in accordance with the present invention, is generally indicated at reference numeral 10 in FIG. 1. The brake is shown in a braking mode. The brake has a forward bias unit 12, a slave piston 14, and a master piston 16.

The slave piston 14 is mounted for reciprocating motion in a fluid cavity 18. One end 20 of the slave piston is adapted to contact the cross-head 22 or other operating means for the exhaust valves 24 of an internal-combustion engine.

A solenoid valve 36 and check valve, represented at reference numeral 26, allows engine oil under engine oil pressure to enter the fluid cavity 8. Once oil enters the fluid cavity through the check valve, the oil is trapped within the cavity and can only exit the cavity when the check valve is displaced by the solenoid valve.

The slave piston 14 has a predetermined surface area 28 which in the preferred embodiment is equal to approximately 0.785 square inch. A return spring 30 biases the slave piston to a retracted position under a predetermined retracting force. The force biases the piston 14 against movement caused by the pressure of engine oil in fluid cavity 18. Engine oil is supplied from sump 32 by engine oil pump 34 at a pressure of about 35 psig to the check valve 26 through a solenoid-operated control valve 36. Thus, the downward force acting on the predetermined surface area of the slave piston from oil pressure alone is approximately 27 lbs.

The forward bias unit 12 provides a supplemental force to the surface of the slave piston to assist the engine oil pressure in overcoming the retracting force of the return spring. The forward bias unit has a threaded housing 38 containing a compression spring 40 and a loose tolerance finger 44. The loose tolerance finger is mounted for reciprocating motion within the threaded housing and has an outer end which can protrude from the housing in an extended position and which can retract into the housing. The outer end is adapted to contact the surface 28 of the slave piston. The inner end or top of the finger has a flange 46 to limit the amount of outward extension of the finger. In the alternative, rather than have a flange on the top of the finger 44, the finger can be a continuous cylinder with a pin passing diametrically through the finger near the top of the finger to limit the amount of outward movement of the finger. The spring 40 rests on the pin rather than the flange in such an alternative embodiment. The compression spring exerts a minimum force against the finger when the finger is in the extended position and a maximum force when in the retracted position. By substituting different length fingers, the finger can be varied to alter the amount of extension of the finger.

There is a small aperture 29 extending through piston 14, at the centre of surface 28 in this embodiment. The aperture is below finger 44 which normally seals aperture 29 by contacting a flat portion of surface 28 about the aperture.

For proper operation of the brake, the maximum force of the compression spring 40 cannot exceed the retracting force of the return spring 30 within the slave piston, so that when the compression brake is deactivated and oil pressure in line 18 decreases, the net resultant force acting on the slave piston overcomes the force on finger 44 and biases the slave piston to the retracted position. The minimum force of the compression spring must be sufficient to provide a net resultant force, which is a combination of the force due to engine-oil pressure acting on the predetermined surface of the slave piston and the minimum force due to the extended compression spring, such that the slave piston is biased to its extended position when the brake is activated. For the embodiment disclosed in U.S. Pat. No. 4,655,178, a compression spring having a minimum compressive force of 43 lbs. and a maximum compression force of less than 70 lbs. over a distance equal to the length of the extended portion was used. In practice, in some cases there was not sufficient space available in some engines for the size of spring thus required. The valve cover could be raised by changing the casting used for brake 10, but this may be uneconomical. A weaker spring 40 could be used. Thus the total force available from the oil pressure in chamber 18 and the force of spring 40 is less than required to overcome the spring 30 previously employed. If spring 40 is weaker then this might suggest that a weaker spring 30 could be used, but this presents the risk of the oil pressure alone depressing piston 14 against the weaker spring 30. This opportunity arises each cycle when valves 24 are opened on the exhaust cycle and springs 48 do not act against the slave piston. If slave piston 14 moves downwardly away from finger 44, it cannot move back during brake operation because of oil entering cavity 18 which cannot return through check valve 26. Thus the slave piston may be jacked down further on each cycle. To prevent this, the aperture 29 is provided in piston 14. The flange 46 limits downward movement of finger 44. Any further downward movement of piston 14 therefore exposes aperture 29 and allows oil from cavity 18 to escape through the aperture where it is dumped back to the crankcase. The spring 30 therefore holds piston 14 upwardly in the illustrated position in contact with finger 44 and eliminates the risk of resulting engine damage.

Typically, a clearance of 0.018 inch exists between the end 20 of the slave piston 30 and the cross-head 22 when the engine is cold. This clearance is required to allow for thermal expansion of the exhaust valves 24 when the valves are brought up to engine operating temperature. The clearance between the end of the slave piston and the cross-head must slightly exceed the expected linear expansion of the exhaust valves so that the exhaust valves are not open throughout the normal operation of the engine when the compression brake is not in effect. To operate the brake in this embodiment, it is desirable to take up this cold clearance or lash so that the exhaust valves can be held open during the engine cycles. That is because in certain cases, such as some Cummins engines, the pressure built up in the cylinder during brake operation required high valve opening forces and excessive loading on valve opening components. This high pressure is relieved by keeping the exhaust valves partly open.

By providing the extended portion of the loose tolerance finger 44 with a length of 0.108 inch in this example, the exhaust valves 24 will always remain in a slightly cracked or open position when engine oil under engine oil pressure is present within the fluid chamber 18. The length of the finger can be made smaller to merely take up some of the cold clearance but not keep the valves open continuously during the brake operation or can be made longer to crack open the valves a greater amount.

The compression spring 40 in this example has a compressive force ranging between 8 lbs when in the extended position to 10 lbs in the compressed position. Spring 30 has a force ranging from 25 lbs to 28 lbs. These figures will vary from engine to engine. The net force of the oil pressure in chamber 18 plus that of spring 40 moves the slave piston down to contact the exhaust crosshead, taking up the initial 0.018 clearance. When the master piston is driven up, the slave piston is displaced downwards another 0.080". While held in this position by the fluid displaced by the master piston, the normal exhaust stroke occurs and the pressure, caused by the valve springs 48 is removed from the slave piston. With the valve spring pressure removed, the spring 40, acting in concert with the normal engine oil pressure moves the slave piston an additional 0.010" to trap an extra increment of oil. The total slave piston travel has now been 0.018"+0.080"+0.010" for a total of 0.108" which is the travel limit of the loose tolerance finger. Further slave piston movement is not possible as the spring 40 no longer helps and engine oil pressure alone cannot move the slave piston because aperture 29 would be uncovered in the slave piston.

The master piston 16 provides a high-pressure pulse of oil which enters the fluid cavity to crack open the exhaust valves near the end of the compression stroke.

The master piston reciprocates in a master cylinder 50 which communicates with the fluid cavity 18. The master piston can be driven off a fuel injection camshaft 51 which can be adjusted to pulse the master piston appropriately.

The forward bias unit is provided with the threaded housing 38 so that the cold clearance of the brake 10 can be adjusted.

The compressive force of the compression spring 40 can be controlled by rotating an adjustable plug 52.

It will be appreciated that other embodiments and variations of the invention are also contemplated. For example, the forward bias unit need not be positioned above the slave piston as illustrated. The forward bias unit could be incorporated into the slave piston to react against the surface of the fluid cavity. Thus, the scope of the invention is not to be limited by the above description, but is to be determined by the scope of the claims which follow.

I claim:

1. A compression relief engine brake for internal-combustion engines, comprising:

an engine having an engine oil pump, exhaust valves, and means for actuating the exhaust valves;

a fluid cavity for accepting engine oil under normal pressure to the fluid cavity;

a slave piston having a predetermined surface area exposed to the fluid cavity, mounted for reciprocating motion within the fluid cavity, wherein the slave piston has a retracted position defining a maximum clearance between one end of the slave piston and the exhaust valve actuating mechanism and an extended position wherein the clearance between the end of the slave piston and the exhaust valve actuating mechanism, is reduced;

means for biasing the slave piston to the retracted position under a predetermined retracting force;

means for applying to the slave piston over a limited distance a net force exclusive of the retracting force and oil pressure which biases the slave piston towards the extended position and does not exceed the retracting force, wherein the resultant force due to the force imposed by oil pressure within the fluid cavity acting on the predetermined surface area of the slave piston and the net force exceeds the predetermined retracting force so that the slave piston is biased to the extended position over the limited distance through which the net force acts;

means for temporarily trapping the oil in the fluid cavity so that displacement of the slave piston in the direction of the extended position is maintained due to the incompressibility of the temporarily trapped oil; and means for eliminating movement of the slave piston beyond said limited distance through which the supplemental force acts.

2. The brake of claim 1 wherein the limited distance over which the supplemental force applying means operates is sufficient to hold the exhaust valves in a first open position after the valve camshaft has opened the exhaust valves on an initial exhaust stroke during operation of the brake.

3. The brake of claim 1 wherein the limited distance over which the supplemental force-applying means operates is sufficient to eliminate cold clearance between the end of the slave piston and the exhaust valve operating means during operation of the brake.

4. The brake of claim 1 wherein the limited distance over which the supplemental force applying means operates is sufficient to only partially eliminate cold clearance between the end of the slave piston and the exhaust valve operating means during operation of the brake.

5. A combination compression relief engine brake and an internal-combustion engine, comprising:

an engine having an engine oil pump, exhaust valves, a valve camshaft, and means for operating the exhaust valves from the valve camshaft wherein the exhaust valves are biased to a closed position and wherein depression of the exhaust valve operating means opens the exhaust valves;

a fluid cavity for accepting engine oil under engine oil pressure;

means for supplying engine oil under engine oil pressure to the fluid cavity;

a slave piston having predetermined surface area exposed to the fluid cavity, mounted for reciprocating motion within the fluid cavity, wherein the slave piston has a retracted position defining a maximum clearance between one end of the slave piston and the exhaust valve operating means and an extended position for reducing the clearance between the end of the slave piston and the exhaust valve operating means, an aperture extending through the slave piston from the fluid cavity to a side of the slave piston outside the fluid cavity;

means for biasing the slave piston to the retracted position under a predetermined retracting force;

a forward bias unit including means for applying to the slave piston over a limited distance a net force, exclusive of the retracting force and oil pressure, which biases the slave piston towards the extended position and does not exceed the retracting force, the forward bias unit having a threaded housing to adjustably contact the predetermined surface of the slave piston to adjust the maximum clearance between the end of the slave piston and the exhaust valve operating means, the means for applying the net force including a loose tolerance finger with a portion adapted to contact the surface of the slave piston over the limited distance and a compression spring applying the net force against the loose tolerance finger, wherein the net force is less than the predetermined retracting force but is sufficient to bias the slave piston to the extended position when the engine oil pressure acts on the surface of the slave piston, the tolerance finger sealing said aperture through the slave piston when contacting said surface;

means for temporarily trapping engine oil in the field cavity so that displacement of the slave piston in the direction of the extended position is maintained due to the incompressibility of the temporarily trapped oil; and means for relieving the engine oil pressure from the fluid cavity when the brake is deactivated.

6. The brake of claim 5 wherein the extendable portion of the loose tolerance finger has a length sufficient to apply the supplemental force over the limited distance to hold the exhaust valves in a first open position after the valve camshaft has opened the exhaust valves on an initial exhaust stroke during operation of the brake.

* * * * *